United States Patent [19]

Le Hong et al.

[11] Patent Number: 4,548,220

[45] Date of Patent: Oct. 22, 1985

[54] DEVICE FOR CHECKING METAL PIECES, MORE PARTICULARLY COINS

[75] Inventors: Son Le Hong, Villebon sur Yvette; Henri Martin, Chatel Guyon, both of France

[73] Assignee: Compagnie de Signaux et d'Enterprises Electriques, France

[21] Appl. No.: 495,158

[22] Filed: May 17, 1983

[30] Foreign Application Priority Data

Mar. 9, 1983 [FR] France ..... 83 03897

[51] Int. Cl.[4] ..... G07D 3/00

[52] U.S. Cl. ..... 133/3 H; 194/100 A; 221/182

[58] Field of Search ..... 194/100 A; 133/1 R, 133/1 A, 3 R, 3 B, 3 E, 3 H, 4 R, 4 A, 5 R, 8 R, 8 A; 221/182; 232/7, 9, 12–16

[56] References Cited

U.S. PATENT DOCUMENTS

| | | | |
|---|---|---|---|
| 902,067 | 10/1908 | Froberg | 133/8 R |
| 1,749,421 | 3/1930 | Donnellan | 133/3 E |
| 2,644,470 | 7/1953 | Labbe | 133/5 R |
| 3,788,440 | 1/1974 | Propice et al. | 194/100 A X |
| 4,398,550 | 8/1983 | Shireman | 133/5 R X |

FOREIGN PATENT DOCUMENTS

| | | | |
|---|---|---|---|
| 7392 | 4/1905 | United Kingdom | 133/3 R |

*Primary Examiner*—F. J. Bartuska

*Attorney, Agent, or Firm*—Steele, Gould & Fried

[57] ABSTRACT

A device for sorting and checking metal pieces such as coins, comprising: a first sloping rotary disk for operation as a separation disk, onto which coins are to be thrown in mixed types and random orientations and which is provided at its periphery with pockets, each pocket adapted to receive one and only one coin; a second sloping rotary disk for operation as a detection disk, also provided with pockets at its periphery and rotating in synchronism with the first disk but in reverse direction about a parallel axis, the second disk having an axis placed higher than the first disk, and the second disk occupying a plane slightly below the first disk with the disks partially overlapping, whereby a coin in a pocket of the first disk is transferred to a pocket of the second disk by action of gravity at a culminating point of its travel; and, a coin recognition device comprising a number of electromagnetic sensors disposed along a path of the pockets of the second disk.

12 Claims, 10 Drawing Figures

DEVICE FOR CHECKING METAL PIECES, MORE PARTICULARLY COINS

BACKGROUND OF THE INVENTION

The present invention relates to a device for checking metal pieces, intended more particularly for coins or tokens, for example for automatic paying of toll charges on motorways or for parking, but which could also be used for other purposes for example for sorting out bearings or gear-wheels.

Different constructions are known for devices for checking coins in automatic toll charge paying stations. However with most of these checking devices, authentication of a large number of different coins cannot be provided with sufficient reliability and rapidity, since some of these coins may be very closely related in their physical appearance, particularly if different foreign coins must also be taken into account.

SUMMARY OF THE INVENTION

The present invention has then as principal aim to remedy this disadvantage and, for this, it provides a coin checking device which is essentially characterized in that it comprises:

a first tilted rotary disk, called the separation disk, on which the coins are thrown higgledy-piggledy regardless of their orientation and type, and which is provided at its periphery with pockets each adapted to receive one and only one coin, a second tilted rotary disk, called the detection disk, also provided with pockets at its periphery and rotating in synchronism with the first one but in the opposite direction about a parallel axis, the axis of this second disk being higher than that of the first disk, while the plane of the second disk is slightly below that of the first disk, with the disks partially overlapping, so that the coin located in a pocket of the first disk is transferred to a pocket of the second disk at the culminating point of its travel path, and a device for recognizing coins comprising a number of electromagnetic sensors disposed in the path of the pockets of the second disk.

Thus, by using two disks, one for physically separating the coins, one by one, and the other for the detection of their geometrical or electromagnetic characteristics, a much higher sorting speed may be obtained. In fact, this differentation of functions allows disks of very small diameter to be used which can then be rotated more quickly, resulting in a reduction of the transfer time of the coins in the apparatus.

The result is also increased reliability since the probability of gripping each coin is increased and thus reduces its dwell-time in the apparatus. There is then finally less friction and consequently less wear of the mechanical elements.

Preferably, the separation disk comprises pockets whose edges are chamfered.

Thus, when several coins are situated in the same pocket, those which are in excess readily fall back under the effect of gravity at the moment when the pocket rises.

Moreover, a scraper formed by a flexible blade is disposed in the path of the pockets of the separation disk.

It may in fact happen that two coins remain stuck to one another because of dirt or humidity. In this case, the coin which is overlapping is pushed back downwards by the scraper, so that the detection disk never receives more than a single coin in the same pocket.

Preferably, also, the separation disk is metallic whereas the detection disk is made from a plastic material or similar.

It is in fact necessary for the separation disk to be robust in order to withstand the impact of the coins arriving. On the contrary, the detection disk does not need to be as strong but must, on the other hand, be non metallic so as not to disturb the electromagnetic recognition of the coins. This arrangement, made possible by the differentiation of the functions, allows the reliability to be increased with respect to known apparatus only comprising a single disk made from a plastic material.

In a particular embodiment of the invention, the device for recognizing coins comprises three electromagnetic sensors assigned respectively to checking the material forming the coin, to measuring its diameter and to measuring its thickness.

It is thus possible to select the different coins with very great reliability and in particular to distinguish coins having different values but whose physical appearance are very closely related.

The checking device of the invention further comprises advantageously an automatic clearing device allowing the lid covering the two disks to be raised in the case of a jam.

Preferably, this clearing device comprises an electromagnet responsive to a slowing down of the rotational speed of the disks and acting on a locking lever of the lid.

Moreover, means are provided for rotating the separation disk in the opposite direction when the lid is raised.

Thus, when unusual objects are introduced into the apparatus and cause packing or even jamming, they can be automatically removed to a return cup provided for this purpose and which is normally accessible to the user.

The checking device of the invention further comprises a device for displaying batches of accepted coins, for example batches corresponding to a given payment, this device being formed by a scraper with several arms, over which is mounted a transparent cover, and rotating on a circular plate situated in the plane of the separation and detection disks, the coins of each batch falling by gravity into an angular sector formed by two of the arms of the scraper by travelling along a sloping passage disposed at the outlet of the detection disk and this scraper being controlled in rotation so as to rotate by the value of a sector after each payment, as far as an aperture formed in the circular plate through which the batch of coins considered is removed to be recovered and stored.

The operating staff, as well as the user, may thus see for a certain length of time the composition of the batch of coins forming a given payment, which allows most disputes, which are likely to arise, to be settled rapidly.

The checking device of the invention finally comprises a device for ejecting unaccepted coins, formed by a hinged trap-door arranged in the sloping passage disposed at the outlet of the detection disk, this trap-door being actuated by means of an electromagnet controlled by the coin recognition device.

The unaccepted coins then fall automatically into the return cup accessible to the user.

BRIEF DESCRIPTION OF THE DRAWINGS

One embodiment of the invention is described hereafter by way of example, with reference to the accompanying drawings in which.

DETAILED DESCRIPTION OF THE PREFERRED EMBODIMENTS

Figure 1:
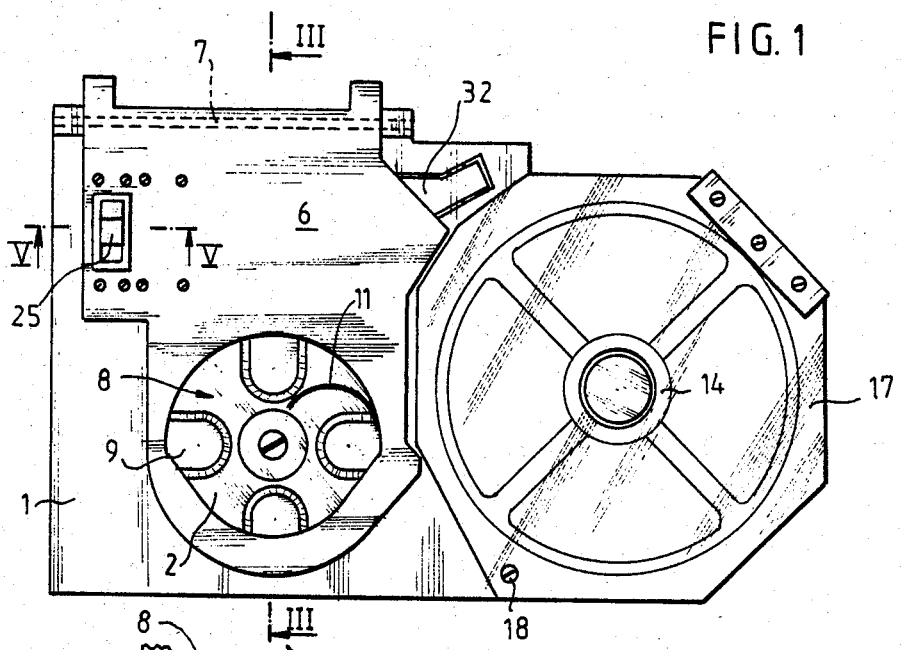
FIG. 1 is a simplified top view of a coin checking device in accordance with the invention.
Figure 2:
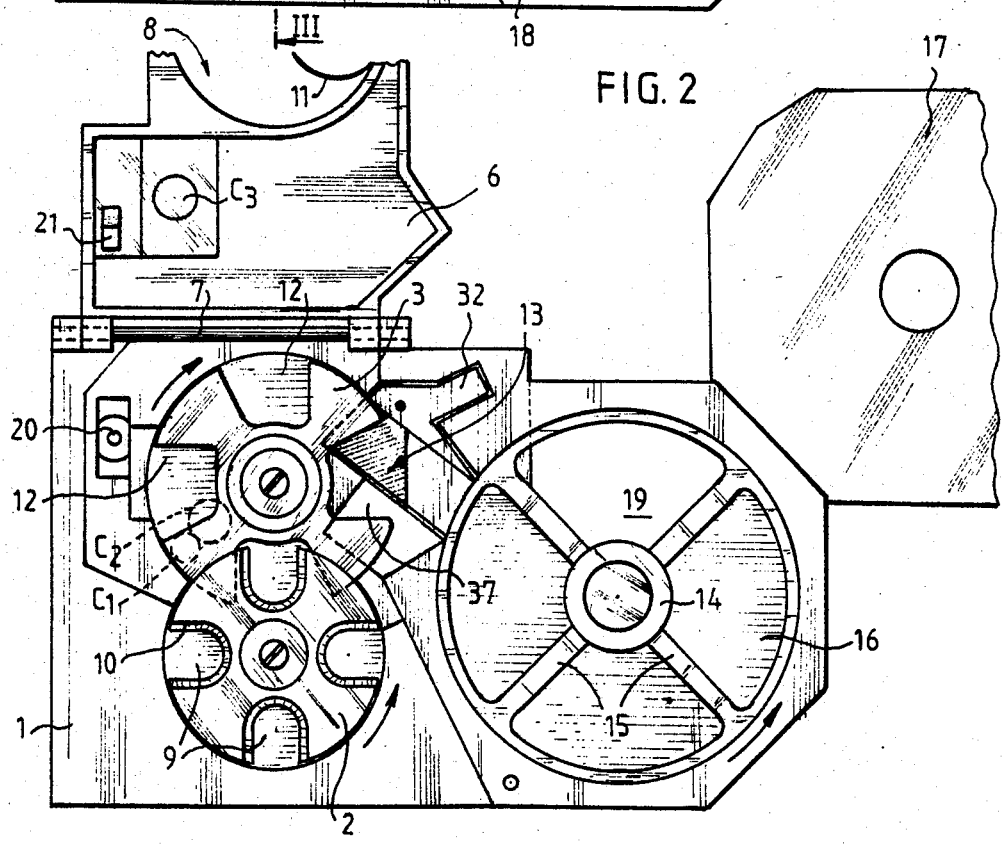
FIG. 2 shows the same view, but with the two lids raised.
Figure 3:
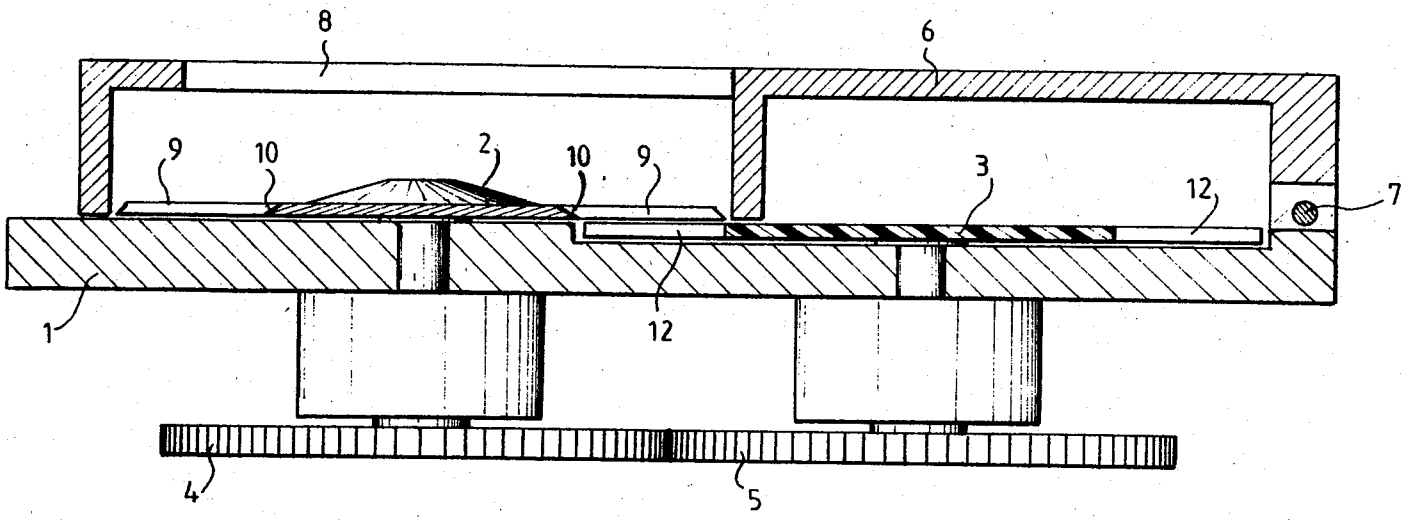
FIG. 3 is a sectional view along the line III—III of FIG. 1.

Referring to FIGS. 1 to 3, it can be seen that the coin checking device of the invention comprises first of all a base 1 on which is mounted a sorting device formed essentially by two rotary disks 2 and 3 with open pockets, rotating about parallel axes. Normally, base 1 is sloping with respect to the horizontal, for example by 45°, so that disks 2 and 3, which are situated parallel to its plane, are also sloping by the same amount. These two disks are aligned vertically, disk 2 being situated in the lower part and disk 3 in the upper part. Moreover, and as can be seen more clearly in FIG. 3, these two disks are not situated exactly in the same plane, the plane of disk 2 being slightly above that of disk 3, and dimensioned so that the disks partially overlap.

The axes of the two disks are connected together by gear-wheels, respectively 4 and 5, so as to rotate in synchronism but in the reverse direction with respect to each other, under the action of an appropriate drive means (not shown).

The two disks are normally covered by a lid 6 hinged at 7 to frame 1. This lid 6 is provided with an opening 8 through which randomly-oriented and mixed coins are thrown directly higgledy-piggledy on to the lower disk 2. Generally, aperature 8 is preceded by a reception basket facilitating collection of the coins.

The lower disk 2, called the separation disk, is made from metal, so as to resist the impacts of the coins arriving and comprises four open pockets 9 spaced evenly apart at 90° from each other. The shape and the size of these pockets are such that only a single coin may be inserted completely therein. Moreover, the edges of said pockets are chamfered, as shown at 10, so that the excess coins may readily fall back under the effect of gravity during rotation of the disk. A scraper 11, formed by a flexible blade, is further provided on lid 6 for pushing downwards the coin in excess which might have remained in one of pockets 9.

The upper disk 3, called the detection disk, is made from a plastic material or similar, so as not to disturb the electromagnetic recognition of the coins which is carried out at this level. It also comprises four open pockets 12 evenly spaced apart. Furthermore, the two disks are suitably adjusted with respect to each other, so that the pockets 9 of the first disk coincide with the pockets 12 of the second disk during rotation.

The operation of this sorting device will now be briefly described, with reference more particularly to the diagrams of FIGS. 4A to 4D.

Figures 4A, 4B, 4C, 4D:
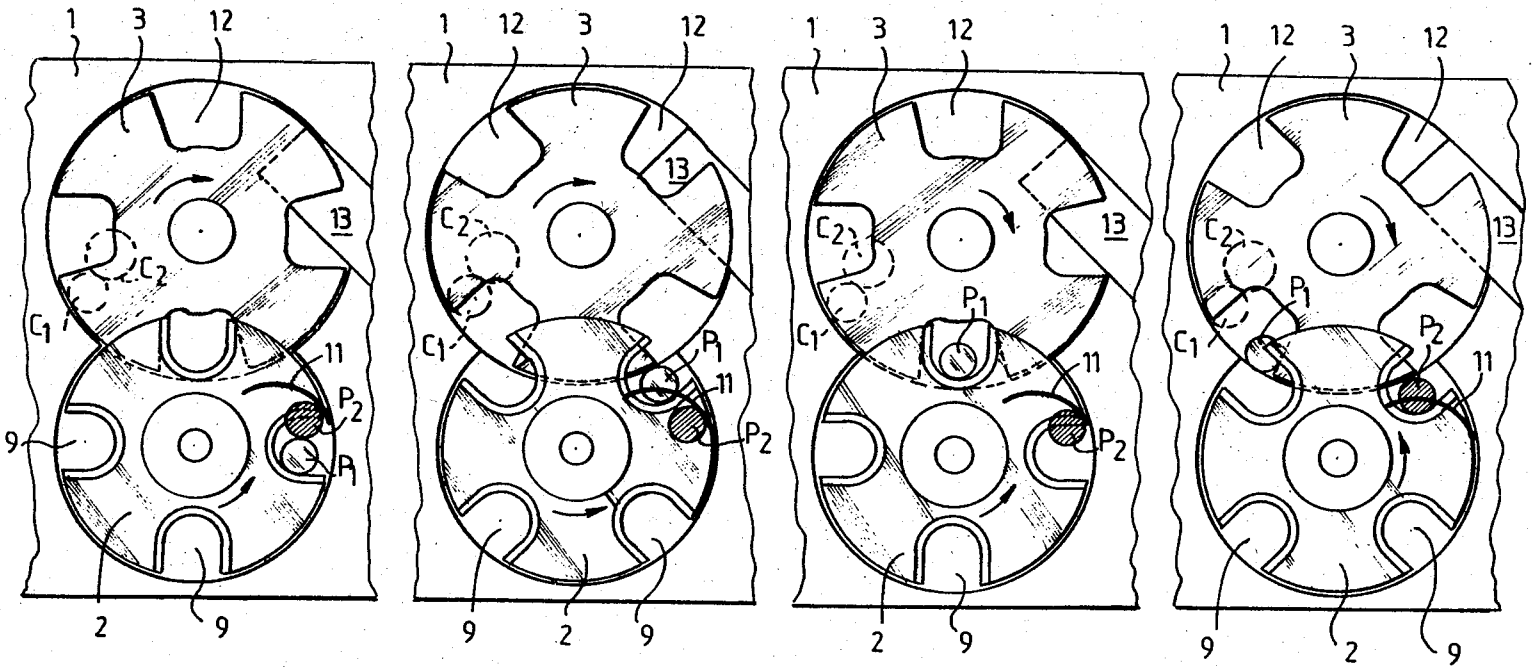
FIGS. 4A to 4D are schematical views showing the operation of the coin checking device of the invention.

In FIG. 4A, it can be seen that two coins $P_1$ and $P_2$ are in the same pocket 9 of the separation disk 2. However, only coin $P_1$ has been fully inserted therein, coin $P_2$ partially overlapping the surface of the disk.

Under the action of scraper 11, coin $P_2$ is pushed downwards, as shown in FIG. 4B, and is normally then inserted into the next free pocket, as shown in FIG. 4C. Coin $P_1$ is then at the culminating point of disk 2, just above a pocket 12 of the detection disk 3 and is then automatically transferred on to this disk 3 by falling by gravity effect into the corresponding pocket. Coin $P_1$ then continues its upward travel under the action of disk 3, as shown in FIG. 4D, whereas coin $P_2$ is conveyed by disk 2 for transfer in its turn to the next free pocket of this same disk 3.

It can then be finally seen that with this set of arrangements, the detection disk 3 can never receive more than a single coin at one and the same time in the same pocket, which is necessary if correct detection of these different coins is to be provided.

The detection properly speaking takes place by means of an electronic coin recognition device which will not be described in detail here. It will be simply mentioned that this detection is achieved from information provided by three electromagnetic sensors $C_1$, $C_2$ and $C_3$ each formed by a coil connected in an open magnetic circuit formed by a half ferrite pot. These sensors provide a wide magnetic field distribution in the air at the position where the coins pass. Each coil forms the induction coil of a tank circuit excited and tuned to a mean frequency at rest.

When a coin passes through the field radiated by the sensor, there is a variation of the apparent inductance and of the resistance of the tank circuit, which causes an amplitude variation of the electric signal generated and of its frequency by detuning of the tank circuit. These variations are measured with respect to a relative rest point which is established in the absence of a coin.

The three sensors are independent and operate at separate frequencies. Two of them, namely sensors $C_1$ and $C_2$, are situated under the detection disk 3 and the role of the first one is to check the material of which the coin is made and of the second to check its diameter. They are slightly offset in their relative angular positions. The third sensor $C_3$ is situated under lid 6, opposite $C_1$ and $C_2$, and it is responsive to the thickness of the coin.

Sensor $C_1$ is disposed at the periphery of the detection disk 3 and is of a sufficiently reduced size to be completely occulted by the smallest of the coins to be recognized, these latter being forced to pass to the periphery because of the slope of the corresponding edge of pockets 12. This sensor is only responsive to the material of the coin. On the contrary, sensor $C_2$ is spaced away from the periphery of the disk, so that it is never completely covered by any one of the coins, while remaining responsive to the smallest of them. It thus allows the diameter to be determined by measurement of the occultation rate. Sensor $C_3$, situated on the lid, is also placed at the level of the periphery of the disk for determining the thickness of the coin by checking the air gap remaining between the surface thereof and the sensor.

The electronic coin recognition device proceeds by analyzing the information delivered by the three sensors, by means of a microprocessor. However, the system is independent of the speed of rotation of the disks of the sorting device, of the fluctuations in speed and of time. The principle is based on the comparison of the minimas and maximas of the differences in amplitude and frequency provided by the measurements with respect to the corresponding preprogrammed parameters taken from a table of characteristics specific to the types of coins accepted. This process does not then limit the number of types of coins recognized and may be easily adapted to any kinds of domestic or foreign coins, present or future, as well as to all types of tokens created for specific applications such as subscriptions or games. Of course, it will also be necessary in some cases, and depending on the applications in view, to modify the dimensions of pockets 9 and 12.

On leaving the sorting device, the coins pass automatically into a sloping passage, designated generally by the reference 13, and which is placed opposite the position of the sensors. They then slide under gravity effect along this sloping passage 13 and thus reach a device for displaying the batches of accepted coins which will now be described. This device is formed essentially by a flat scraper 14 with four arms 15, rotatably mounted on a smooth circular plate 16 situated in the plane of disks 2 and 3 of the sorting device. The assembly is covered by a transparent lid 17, hingedly mounted on base 1 and which is normally held in the closed position by means of a pin 18.

During a given payment, the coins accepted fall under gravity effect into the angular sector, formed by the gap between two arms 15 of scraper 14, which is at that moment opposite the sloping passage 13 for coins leaving the sorting device. At the end of the transaction, scraper 14 is rotated a quarter of a revolution in the direction indicated by the arrow and thus presents the next angular sector in front of passage 13. After three successive payments, the batch of coins considered has rotated by three quarters of a revolution and is then at the level of an opening 19 formed in plate 16 through which the coins are removed to be recovered and stored.

The operating staff and the user can thus permanently see the composition of the batches of coins forming the last three payments, because of transparent lid 17, so as to remove any possibility of dispute. It will be further noted that, since scraper 14 pushes the coins by sliding over a fixed support plane, they do not risk remaining stuck thereon because of damp or considerable amounts of dirt.

Figure 5:
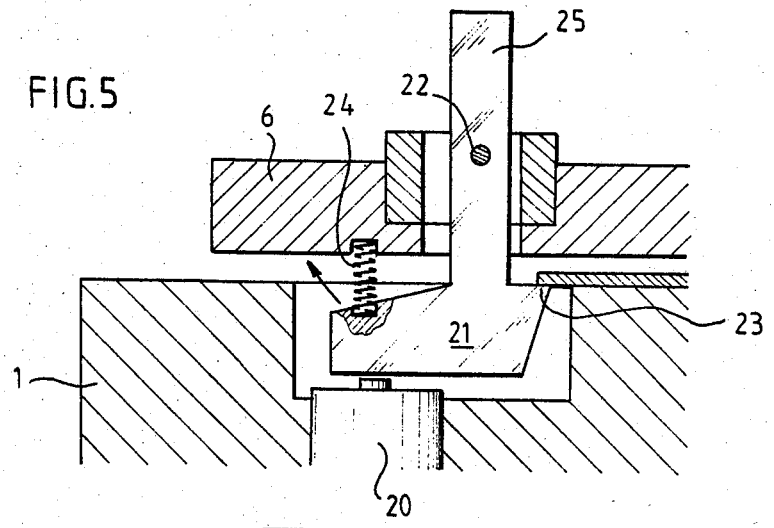
FIG. 5 is a detail view in section along line V—V of FIG. 1.

The checking device of the invention is further equipped with an automatic clearing device allowing the lid 6 of the sorting device to be momentarily raised should jamming occur therein, so as to rapidly remove the coins which are too large or the unusual objects which might be thrown into the coin reception basket. As can be seen more clearly in FIG. 5, this clearing device is essentially formed by an electromagnet 20 acting on a lever 21 which normally ensures locking of lid 6 to base 1. Lever 26 is pivoted at 22 to lid 6 and comprises a nose 23 engaging on base 1 under the action of a return spring 24.

Electromagnet 20 is actuated when a slowing down of the rotational speed of the sorting device is ascertained or even jamming thereof under the effect of coins or objects present on the separation disk 12 which are too large. This speed detection may be very easily accomplished by means for example of a photoelectric cell cooperating with equidisatant holes formed in one of the drive pinions of the disk.

When it is actuated, electromagnet 20, through its rod, pushes the rear part of lever 21 and thus, in a first stage, unlocks lid 6 then raises it by an amount which is determined by the travel of said electromagnet. The lid then falls back automatically under the effect of its own weight and is again locked to base 1 by nose 23 of lever 21 under the action of the return spring 24.

When lid 6 is raised, the unusual coins or objects which are jamming the separation disk 2 simply fall under the effect of gravity into a return cup, not shown, placed on the front of the apparatus and which is normally accessible to the user. Simultaneously, the separation disk is rotated in the reverse direction, for example by a quarter of a revolution, so as to ensure possible freeing of overlapping coins.

It will be further noted that lever 21 is accessible from the outside by means of an extension 25, thus allowing the lid 6 to be raised manually so as to have access to the disks of the sorting device during maintenance operations.

Figure 6:
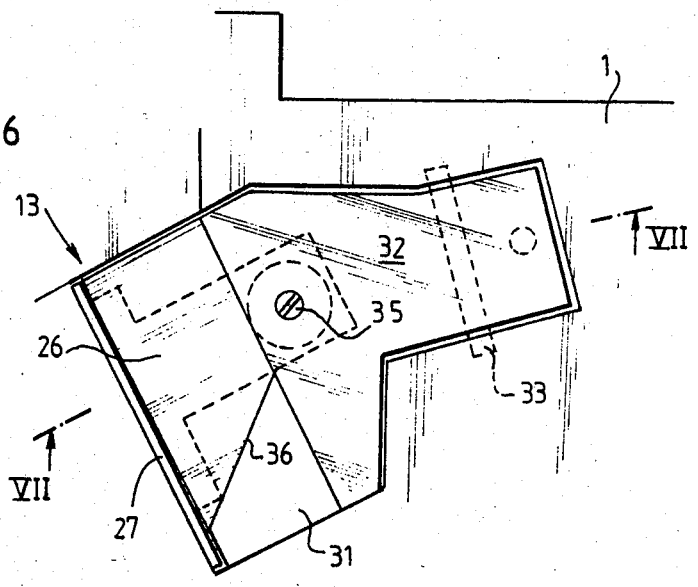
FIG. 6 is a detail top view of the device for ejecting unaccepted coins.
Figure 7:
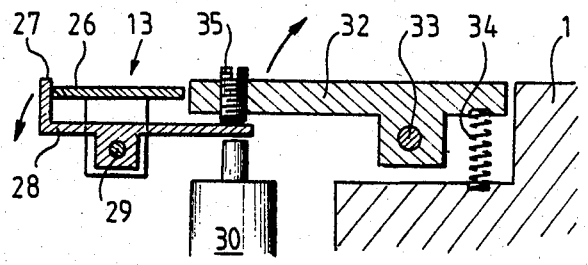
FIG. 7 is a sectional view along line VII—VII of FIG. 5.

The checking device of the invention is completed by a device for automatically ejecting unaccepted coins, which will now be described with reference more particularly to FIGS. 6 and 7. This device is in fact provided at the level of the sloping passage 13 through which coins leave the sorting device. It can in fact be seen in the figures that this passage 13 is essentially formed by a fixed bottom 26 cooperating with a flange 27 for retaining the edge of the coins and which is movable so as to form a retractable trap-door.

Flange 27 forms part of a plate 28, hinged at 29 to frame 1 and which is capable of being maneuvered by means of an electromagnet 30 controlled by the electronic coin recognition device. Moreover, the lower end of passage 13 is formed by an extension 31 of another plate 32 hinged at 33 to frame 1. This plate 32 is subjected to the action of a return spring 34 and thus bears, through an adjusting screw 35, on plate 28 carrying flange 27. It will be further noted that the connection between the bottom 26 of passage 13 and the extension 31 of plate 32 takes place along an inclined edge 36 whose role will appear more clearly further on.

When the coin is recognized as good by the electronic coin recognition device, it slides without difficulty along the sloping passage 13 while being retained by flange 27 and then falls into the corresponding angular sector of scraper 14. So that edge 36 does not risk hindering this sliding movement, extension 31 is normally held in a plane slightly lower than that of bottom 26 by means of the adjusting screw 35.

On the other hand, when the electronic coin recognition device considers that a coin is false or that it is a coin not accepted as method of payment, it actuates the electromagnet 30 in synchronism with the rotation of the detection disk 3, at the precise moment when said unaccepted coin passes into passage 13. Thus, flange 27 moves aside while opening the trap-door and the coin then falls directly into an opening 37 specially provided for this purpose to then fall into the return cup accessible to the user. Under the action of the electromagnet 30, extension 31 is also raised upwardly and its edge 36 then projects into passage 13, so that the unaccepted coin cannot reach the scraper 14 and is forced to fall into opening 37 by coming into abutment against this edge 36.

The coin checking device which has just been described presents very great reliability, while being of high performance. In this connection, the performances are essentially expressed by the time for recognizing the coins of a batch representing a complete payment, from the moment when the coins are thrown into the reception basket, to the moment when the last coin of the batch thus thrown is recognized. By way of example, such a checking device provides a time of the order of 0.8 sec for the first coin and a time less than 0.2 sec for each subsequent coin.

What is claimed is:

1. A device for sorting and checking metal pieces such as coins, comprising:

a first sloping rotary disk for operation as a separation disk, onto which the coins are to be thrown in mixed types and random orientations and which is provided at its periphery with pockets, each pocket adapted to receive one and only one coin;

a second sloping rotary disk for operation as a detection disk, also provided with pockets at its periphery and rotating in synchronism with the first disk but in reverse direction about a parallel axis, the second disk having an axis placed higher than the first disk, and the second disk occupying a plane slightly below the first disk with the disks partially overlapping, whereby a coin in a pocket of the first disk is transferred to a pocket of the second disk by action of gravity at a culminating point of its travel; and, a coin recognition device comprising a number of electromagnetic sensors disposed along a path of the pockets of the second disk.

2. The device according to claim 1, wherein the separation disk comprises pockets having chamfered edges around their periphery.

3. The device according to claim 2, further comprising a scraper formed by a flexible blade disposed along a path of the pockets of the separation disk.

4. The device according to claim 1, wherein the separation disk is made from metal, and the detection disk is made from a non-metallic material.

5. The device according to claim 1, wherein the coin recognition device comprises three electromagnetic sensors respectively operable to determine for each coin its material of construction, its diameter, and its thickness.

6. The device according to claim 1, further comprising a device for displaying successive batches of coins accepted, having a scraper with several arms covered by a transparent lid and rotating on a circular plate situated in the plane of the detection disk, the coins of each successive batch falling under gravity into an angular sector formed by two of the arms of the scraper, the circular plate being connected to an outlet of the detection disk by a sloping passage, and said scraper being controlled so as to rotate by the span of a sector after each payment, each successive batch eventually brought to an aperture provided in the circular plate through which the successive batches of coins are removed for recovery and storage.

7. The device according to claim 6, further comprising a device for ejecting unaccepted coins, formed by a hinged trap-door provided in the sloping passage disposed at the outlet of the detection disk, the trap-door being actuated by means of a further electromagnet controlled by the coin recognition device.

8. The device according to claim 4, wherein the detection disk is made from plastic material.

9. The device according to claim 6, wherein the batches correspond to mixed coins of a given payment.

10. A device for sorting and checking metal pieces such as coins, comprising:

a first sloping rotary disk for operation as a separation disk, onto which the coins are to be thrown in mixed types and random orientations and which is provided at its periphery with pockets, each pocket adapted to receive one and only one coin;

a second sloping rotary disk for operation as a detection disk, also provided with pockets at its periphery and rotating in synchronism with the first disk but in reverse direction about a parallel axis, the second disk being having an axis placed higher than the first disk, and the second disk occupying a plane slightly below the first disk with the disks partially overlapping, whereby a coin in a pocket of the first disk is transferred to a pocket of the second disk by action of gravity at a culminating point of its travel;

a coin recognition device comprising a number of electromagnetic sensors disposed along a path of the pockets of the second disk;

a lid covering the separation disk and detection disk; and, an automatic clearing device for raising the lid upon jamming.

11. The device according to claim 10, wherein the automatic clearing device comprises a lever locking the lid and an electromagnet responsive to a slowing down of rotational speed of the disks, the electromagnet acting on the lever locking the lid.

12. The device according to claim 10, further comprising means provided for rotating the separation disk in a reverse direction during raising of the lid.

* * * * *